US005552264A

United States Patent [19]

Cullinan et al.

[11] Patent Number: 5,552,264

[45] Date of Patent: Sep. 3, 1996

[54] PHOTOGRAPHIC CONDITIONING SOLUTION CONCENTRATE CONTAINING BLEACH ACCELERATOR AND FORMALDEHYDE PRECURSOR AND METHOD OF USE

[75] Inventors: Ann M. Cullinan, Rochester; Charles M. Darmon; Rosa P. Sauter, both of Spencerport; Charles F. Leith, Rochester, all of N.Y.

[73] Assignee: Eastman Kodak Company, Rochester, N.Y.

[21] Appl. No.: 417,416

[22] Filed: Apr. 5, 1995

[51] Int. Cl.[6] ..... G03C 11/00; G03C 5/18; G03C 5/26; G03C 5/50

[52] U.S. Cl. ..... 430/372; 430/379; 430/427; 430/428; 430/429; 430/450; 430/458; 430/463

[58] Field of Search ..... 430/372, 379, 430/407, 427, 428, 429, 432, 450, 458, 463

[56] References Cited

U.S. PATENT DOCUMENTS

| | | | |
|---|---|---|---|
| 4,546,069 | 10/1985 | Libicky et al. | 430/450 |
| 4,921,779 | 5/1990 | Cullinan et al. | 430/379 |
| 4,960,682 | 10/1990 | Cullinan et al. | 430/393 |
| 4,975,356 | 12/1990 | Cullinan et al. | 430/393 |
| 5,037,725 | 8/1991 | Cullinan et al. | 430/372 |
| 5,334,493 | 8/1994 | Fujita et al. | 430/372 |

*Primary Examiner*—Charles L. Bowers, Jr.
*Assistant Examiner*—J. Pasterczyk
*Attorney, Agent, or Firm*—J. Lanny Tucker

[57] ABSTRACT

A conditioning or bleach accelerating solution can be used to process color photographic films, especially color reversal films, to minimize magenta dye fade while reducing the needed amount of formaldehyde stabilizer. This solution is provided in highly concentrated form and diluted up to 9:1 prior to or during use. The concentrate contains a formaldehyde precursor at 200 to 450 g/l, a sulfite at from 40 to 100 g/l, a bleach accelerating agent at 1.5 to 13.5, and a metal ion chelating agent at 5 to 45 g/l.

17 Claims, No Drawings

PHOTOGRAPHIC CONDITIONING SOLUTION CONCENTRATE CONTAINING BLEACH ACCELERATOR AND FORMALDEHYDE PRECURSOR AND METHOD OF USE

FIELD OF THE INVENTION

This invention relates in general to color photography and in particular to methods and compositions useful in the processing of color photographic materials, especially color reversal photographic elements. More particularly, this invention relates to an improved pre-bleach stabilizing concentrate, and its use in the processing of the noted materials.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, they utilize color forming couplers that form yellow, magenta and cyan dyes in the sensitized layers during processing.

After color development, it is necessary to remove the silver image that is formed coincident with the dye image. This can be done by oxidizing the silver using a suitable oxidizing agent, commonly referred to as a bleaching agent, in the presence of a halide, followed by dissolving the silver halide so formed using what is known as a fixing agent. In some instances, the bleaching and fixing steps are combined into a single bleach-fixing step.

One commercially important process intended for use with color reversal photographic elements that contain color couplers in the emulsion layers, or layers contiguous thereto, uses the following sequence of processing steps: first developing, washing, reversal bath, color developing, bleaching, fixing, washing and stabilizing. Another useful process has the same steps, but stabilizing is carried out between color developing and bleaching.

In such photographic processes, a bleach-accelerator bath is often used between the color developing and bleaching steps. The bleach-accelerator bath is also known as a "conditioning" bath or solution. It is used to "condition" the metallic silver developed in the two developing steps, for complete oxidation to silver halide and to help preserve the acidity of the bleaching solution by reducing carryover of color developer into the bleaching solution. The conditioning solution contains, as an essential component, an effective amount of a bleach accelerating agent. This agent is imbibed into the emulsion layers of the photographic element during treatment with the conditioning bath, and is accordingly present to exert its intended effect when the element is put into the bleaching solution.

Magenta dye instability is a particularly undesirable problem in color photography, as the magenta dye image may fade more rapidly than either the cyan or yellow dye images. This is particularly evident when arylpyrazolone type magenta dye forming color couplers are used. Thus, considerable effort has been exerted to find solutions to this problem, including the use of dye stabilizers in stabilization baths at the end of the processing method, as described in U.S. Pat. No. 4,786,583 (Schwartz).

It is also known from U.S. Pat. No. 4,921,779 (Cullinan et al), U.S. Pat. No. 4,975,356 (Cullinan et al) and U.S. Pat. No. 5,037,725 (Cullinan et al) that formaldehyde precursors can be incorporated into conditioning solutions to further improve magenta dye stability. These patents describe a number of formaldehyde precursors for this purpose including sodium formaldehyde bisulfite, hexamethylenetetramine and various methylol compounds.

For some time, conditioning solutions for color reversal film processing have been used which contain relatively high concentrations of sodium formaldehyde bisulfite (for example, over 40 g/l and as much as 55 g/l). This effectively solves the magenta dye instability problem but there is a growing concern about the potential health hazards from exposure to formaldehyde during photofinishing. Various governmental regulations are requiring less exposure to formaldehyde.

Copending and commonly assigned U.S. Ser. No. 08/393,293, filed Feb. 23, 1995, now allowed by Darmon et al and entitled "Photographic Conditioning Solution Containing Bleach Accelerator, Formaldehyde Precursor and Secondary Amine and Method of Use" describes the use of a secondary amine in conditioning solutions to enable the amount of formaldehyde precursor to be reduced without compromising the effect of the solution to stabilize magenta dyes in color reversal materials.

However, there is a further need to reduce exposure to formaldehyde in such processing, and to provide customers with an effective conditioning solution that provides both dye stability and bleach acceleration in a more concentrated form so fewer containers are needed by customers.

SUMMARY OF THE INVENTION

The problems noted with known conditioning solutions and processing methods have been overcome using a conditioning solution concentrate comprising a formaldehyde precursor in an amount of less than or equal to about 450 g/l, a sulfite in an amount of from 0 to about 100 g/l, a bleach accelerating agent in an amount of less than or equal to about 13.5 g/l and a metal ion chelating agent in an amount of less than or equal to about 45 g/l.

This invention also provides a method for processing a color reversal photographic element comprising:

A) treating an imagewise exposed and developed color reversal photographic element with a conditioning solution concentrate, as described above, that has been diluted up to 9:1, and B) bleaching the treated element.

The present invention effectively provides a conditioning solution for the processing of color reversal materials that both stabilizes the magenta dye and provides bleach acceleration. This conditioning solution is supplied to the user in a highly concentrated form that is, surprisingly, highly stable and can be diluted by the user up to 9:1 for use as a replenisher during processing. Current product is normally diluted only 4:1.

This stable and effective concentrate is made possible by mixing specific amounts of specific reagents therein. Particularly, the amounts of formaldehyde precursor and sulfite have been reduced from conventional levels, yet magenta dye stability is still maintained when the concentrate is properly diluted and used. Moreover, the amount of metal ion chelating agent is reduced, yet there is sufficient amounts for carryover into the bleaching bath. The reduced level of chemicals makes the conditioning solution more environmentally acceptable.

We have also found that the concentrate of this invention leads to reduced formation of precipitates because of the reduced level of sodium ion, especially in the conditioning and bleaching solutions.

In addition, we found unexpectedly that the reduced level of formaldehyde precursor present in the working solution provided from the concentrate, results in improved retouching dye application.

DETAILED DESCRIPTION OF THE INVENTION

A wide variety of color reversal photographic elements can be used in the practice of the present invention. A detailed description of such materials is found, for example, in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

As explained above, a well-known color reversal process of the prior art utilizes a first developer, a reversal bath, a color developer, a conditioning solution, a bleach bath, a fixing bath and a stabilizer bath. The components that are useful in each of such baths are well known in the photographic art. The improved process of this invention can utilize the same baths except that the stabilizer bath is not needed, that is, the final bath can be a rinse or wash bath consisting of water, or preferably an aqueous solution containing a sufficient amount of a surfactant to prevent spotting of the photographic film. In the present invention, the conditioning concentrate is diluted and used in a separate conditioning step, and is not used in conventional bleaching, fixing or bleach/fixing steps. Thus, the conditioning concentrate does not contain the compounds conventionally used as bleaching or fixing agents.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), and aminophenol developing agents (such as paraaminophenol). In addition to the developing agent, the first developer typically contains other agents such as preservatives, sequestering agents, restrainers, antifoggants, buffers and silver halide solvents.

The reversal bath generally contains a nucleating agent, such as a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include but are not limited to: N,N-diethyl-p-phenylenediamine monohydrochloride, 4-N,N-diethyl-2-methylphenylenediamine monohydrochloride, 4-(N-ethyl-N-2-methane-sulfonylaminoethyl)-2 -methylphenylenediamine sesquisulfate monohydrate, 4-(N-ethyl-N-2-hydroxyethyl)-2 -methyl-phenylenediamine sulfate, 4-N,N-diethyl-2,2'-methanesulfonylamino-ethylphenylenediamine hydrochloride, and others readily apparent to a skilled worker in the art.

The essential component of the bleaching bath is a bleaching agent that converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents but other metal complexes are known in the art, including binary and ternary complexes. Also of particular utility are the persulfate bleaching agents such as ammonium or alkali metal persulfates and peroxide bleaching agents. Bleaching agents can be used individually or in the form of mixtures of two or more bleaching agents.

The fixing bath converts all silver halide into soluble silver complexes that diffuse out of the emulsion layers. Fixing bath retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, by a re-exposure step, or by incorporating a fogging agent in the color developing bath. In order to provide shorter processing times, bleaching and fixing can be combined in a single step (known as a bleach-fixing step).

The present invention is particularly concerned with enhancing dye stability through the use of a bleach-accelerating (or conditioning) solution that contains a bleach accelerating agent, a formaldehyde precursor, a sulfite and a metal ion chelating agent that is supplied in a highly concentrated form prior to use.

The conditioning solution concentrate of this invention is an aqueous acidic solution typically having a pH in the range of from about 4.5 to about 8. Preferably, the pH is from about 4.5 to about 6.5. The pH can be adjusted and maintained using one or more acids or buffers, as would be readily apparent to one skilled in the art.

The concentrate also contains one or more bleach accelerating agents that are generally present in an amount (total amount) of less than or equal to about 13.5 g/l of concentrate and more preferably in an amount of from about 1.5 to about 8 g/l of concentrate. More preferably, the amount is from about 5 to about 6.5 g/l. The working strength concentration of the bleach accelerating agent is, of course, much lower.

Sulfur-containing organic compounds are most commonly used as bleach-accelerating agents in conditioning solutions in photographic processing. However, other types of compounds are also known, including polyalkylene oxides, organic amines, onium compounds, and n-hexoxyethanol. More details of these and the commonly used sulfur-containing compounds are provided in U.S. Pat No. 4,921,779 (noted above) which patent is incorporated herein by reference, and references cited therein. A mixture of bleach accelerating agents can be used if desired.

Preferred bleach accelerating agents include but are not limited to, heterocyclic thiols such as amino-thiadiazolethiol, mercaptotriazole, imidazolethiol and aminomercaptotriazole, disulfides [such as bis(2-aminoethane)disulfide, thioglycerol disulfide and bis(N,N-dimethyl-2-aminoethane)-disulfide] and thioethers (such as dithiaoctanediol and thiadiethanol). Especially preferred are aliphatic thiols of the formula:

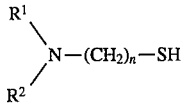

wherein each of $R^1$ and $R^2$ is H, methyl or ethyl and n is an integer having a value of from 1 to 3. Specific examples of such aliphatic thiols include 2-aminoethanethiol, 3-aminopropanethiol, dimethylaminoethanethiol, N-methyl-N-ethyl-aminoethanethiol and diethylaminoethanethiol.

The most preferred bleach accelerating agent for the purpose of this invention is monothioglycerol.

Also included in the conditioning solution concentrate of this invention are one or more formaldehyde precursors.

By the term "formaldehyde precursor" is meant any compound capable of establishing, in the conditioning solution, an equilibrium relationship between it and formaldehyde. While not being certain of the mechanism, it is believed that the precursor acts, in effect, as a formaldehyde donor that gradually releases formaldehyde into the solution at the same rate as it is used up in the dye-stabilizing reaction to thereby maintain the equilibrium relationship. Thus, the concentration of formaldehyde in the bleach-accelerating solution is always at a very low level and there is not enough formaldehyde in the solution to result in a buildup or undesirably high concentrations in the air above the solution.

Formaldehyde precursors that are useful for the purpose of this invention include but are not limited to the water-soluble N-methylol compounds. As used herein, the term "N-methylol compound" refers to a compound having at least one methylol group attached directly to a nitrogen atom. Particularly useful are N-methylol compounds represented by formulae I, II or III in U.S. Pat. No. 4,921,779 (noted above).

Illustrative N-methylol compounds include: dimethylol urea, trimethylol urea, dimethylol guanidine, trimethylol melamine, tetramethylol melamine, pentamethylol melamine, and hexamethylol melamine.

Another particularly preferred N-methylol compound is 1,3-dimethylol-5,5-dimethyl hydantoin.

In addition to the N-methylol compounds, examples of especially effective formaldehyde precursors include sodium formaldehyde bisulfite and hexamethylenetetraamine.

The formaldehyde precursor can be added to the concentrate as a specifically added component, or it can be formed in situ by the reaction of formaldehyde and a bisulfite as one skilled in the art would readily understand.

The formaldehyde precursor is present in the concentrate in an amount of less than or equal to about 450 g/l of concentrate, with an amount of from about 200 to about 300 g/l being preferred, and from about 225 to about 250 g/l being more preferred.

An optional (but preferred) material in the conditioning solution concentrate of this invention is a sulfite preservative (or a plurality thereof). It is present in an amount of from 0 to about 100 g/l of concentrate. Preferably, the sulfite is present in an amount of from 0 to about 80 g/l, and more preferably it is present at from about 40 to about 65 g/l.

Useful sulfites (and corresponding bisulfites) are well known in the art and include, for example, sodium sulfite, potassium sulfite, lithium sulfite, ammonium sulfite and corresponding bisulfites. Potassium and sodium sulfites are preferred.

Also included in the concentrate of this invention is one or more metal ion chelating agents, such as chelating agents for iron, calcium, magnesium, manganese, copper and other metals commonly found in processing solutions. Preferably, chelating agents for iron ions (such as ferric ion) are used. Useful chelating agents are well known in the art, and include for example, ethylenediaminetetraacetic acid, ethylenediaminepentaacetic acid, and other polydentate carboxylic acids, aminocarboxylic acids and phosphonic acids that are generally known for photographic bleaching solutions. The first compound is preferred, but one skilled in the art should understand that there are many useful chelating agents of various composition, molecular weight and effectiveness.

One or more of these chelating agents are present in a total amount of up to about 45 g/l, with amounts in the range of from about 5 to about 30 g/l being preferred.

An optional component of the concentrate of this invention is a secondary amine compound such as those described in the Darmon et al application, U.S. Ser. No. 08/393,293, now allowed, identified above. Such compounds have at least one secondary amine moiety, and may have up to 3 of such groups in the molecule. The secondary amines can be linear or cyclic, as described in the noted application. Preferably, the secondary amines are either dialcoholamines or 6-membered heterocyclic rings having at least one secondary amine moiety in the ring. Representative secondary amines include, but are not limited to, diethanolamine, diisopropanolamine, N-methyl-N-ethylamine, N-hydroxyethyl-N-benzylamine, N-methyl-N-phenylamine, N,N-bis(hydroxyethyl)amine, pyrrolidine, imidazole, 1,4-dihydropyridine, 3-pyrroline, morpholine, piperidine and piperazine. Of these, diethanolamine, morpholine and piperidine are most preferred.

The amount of secondary amine useful in the concentrate is generally at least about 0.75 g/l, with from about 1.5 to about 15 g/l being preferred.

The conditioning solution concentrate of this invention can also include various addenda commonly included in such solutions, as described in the art cited above, including, but not limited to, anti-scumming agents, surfactants, biocides, metal sequestrants, buffers and antioxidants.

The concentrate of this invention can be supplied in any suitable container made of glass, synthetic polymers, metal or various known metal/polymer composites, but preferably, those containers are prepared from synthetic polymers such as high and low density polyethylene, polyvinylidene chloride, various polyamides (such as nylon) or any other material that is inert to the concentrate of this invention. A container can be as small as a single-use packet, vial or bottle, or it can be much larger. Thus, a suitable container can be prepared to hold any suitable volume of concentrate.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure*, noted above. All types of emulsions can be used in the elements, including but not limited to, thin tabular grain emulsions, and either positive-working or negative-working emulsions.

The present invention is particularly useful for processing imagewise exposed and developed photographic elements containing arylpyrazolone type magenta dye forming color couplers. Such color couplers are well known in the art. One such compound is described in U.S. Pat. No. 5,037,725 (noted above).

The elements are typically exposed to suitable radiation to form a latent image and then processed as described above to form a visible dye image.

The concentrate of this invention is generally supplied to the processing equipment after dilution with water of up to 9:1. Alternatively, the concentrate can be diluted as it is being used.

The conditioning step described above is generally carried out for less than 5 minutes, but longer times can be used if desired. Preferably, the conditioning time is from about 0.5 to about 2 minutes. The temperature at which the conditioning step is carried out is generally at or above room temperature, for example from about 20° to about 40° C.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in recently allowed U.S. Ser. No. 08/221,711 (filed Mar. 31, 1994, by Carli et al), now U.S. Pat. No. 5,436,118 and publications noted therein.

As used herein to define amounts and times, "about" refers to ±10% of the indicated value. In reference to temperatures, "about" refers to ±5° C. In defining pH, "about" refers to ±0.5 pH unit.

The following examples are provided for illustrative purposes only and are not intended to be limiting in any way. Unless otherwise indicated, all percentages are by weight.

EXAMPLE 1

Preferred Conditioning Solution Concentrate

A preferred conditioning solution concentrate of this invention was prepared by mixing the following in water (up to 1 liter): sodium formaldehyde bisulfite (250 g), thioglycerol (4 g), potassium sulfite (60 g), phosphoric acid buffer (2 g) and ethylenediaminetetraacetic acid (30 g). The pH was adjusted to 6.15 with potassium hydroxide.

This concentrate was diluted 9:1 with water to prepare a replenisher conditioner solution.

EXAMPLE 2

Use of Conditioner Concentrate Solution

The concentrate of this invention was diluted conditioning solution prepared in Example 1 was evaluated by using it to process samples of a conventional color reversal photographic film (Film Code 6121) using the following processing protocol. This film contained a conventional 1-aryl-5-pyrazolone magenta color coupler in one of the emulsion layers.

| Processing Protocol: | |
|---|---|
| 6 minutes | First Development* |
| 2 minutes | Water wash |
| 2 minutes | Reversal bath** |
| 6 minutes | Color development*** |
| 2 minutes | Conditioning |
| 6 minutes | Bleaching**** |
| 4 minutes | Fixing# |
| 4 minutes | Water wash |
| 30 seconds | Final wash## |
| 20 minutes | Drying |

*Development using conventional KODAK First Developer for Process E-6.
**Reversal bath was conventional KODAK Reversal Bath, Process E-6.
***Color developing using conventional KODAK Color Developer, Process E-6.
****Bleaching using conventional KODAK Bleach, Process E-6.
#Fixing using conventional KODAK Fixer, Process E-6.
Final washing using KODAK Final Rinse, Process E-6.

After the film samples were processed, they were evaluated by liquid chromatography to determine residual magenta color coupler in the element, and also in an accelerated keeping test (at 77° C. and 0% relative humidity) to determine the amount of magenta dye fade. The concentrate of this invention, when appropriately diluted, performed acceptably as a conditional solution in the processing of these reversal elements.

The invention has been described in detail with particular reference to preferred embodiments thereof, but it will be understood that variations and modifications can be effected within the spirit and scope of the invention.

We claim:

1. A conditioning solution concentrate comprising a water-soluble N-methylol compound, sodium formaldehyde bisulfite or hexamethylenetetramine as a formaldehyde precursor in an amount of from about 200 to about 450 g/l, a sulfite in an amount of from about 40 to about 100 g/l, a bleach accelerating agent in an amount of from about 1.5 to about 13.5 g/l, and metal ion chelating agent in an amount of from about 5 to about 45 g/l.

2. The concentrate of claim 1 wherein said bleach accelerating agent is a sulfur-containing organic compound.

3. The concentrate of claim 1 wherein said bleach accelerating agent is an aliphatic thiol.

4. The concentrate of claim 1 further comprising a secondary amine compound in an amount of at least about 0.75 g/l.

5. The concentrate of claim 1 wherein said sulfite is potassium sulfite, sodium sulfite, ammonium sulfite, lithium sulfite or a corresponding bisulfite.

6. The concentrate of claim 1 having a pH of from about 4.5 to about 8.

7. The concentrate of claim 1 wherein said formaldehyde precursor is present in an amount of from about 200 to about 300 g/l, said sulfite is present in an amount of from about 40 to about 65 g/l, said bleach accelerating agent is present in an amount of from about 1.5 to about 8 g/l, and said metal ion chelating agent is present in an amount of from about 5 to about 30 g/l.

8. The concentrate of claim 4 wherein said secondary amine compound is present in an amount of from about 1.5 to about 15 g/l.

9. A method for processing a color silver halide photographic element comprising:

A) treating an imagewise exposed and developed color silver halide photographic element with a conditioning solution concentrate that is diluted up to 9:1, said concentrate comprising a water-soluble N-methylol compound, sodium formaldehyde bisulfite or hexamethylenetetramine as a formaldehyde precursor in an amount of from about 200 to about 450 g/l, a sulfite in an amount of from about 40 to about 100 g/l, a bleach accelerating agent in an amount of from about 1.5 to about 13.5 g/l, and metal ion chelating agent in an amount of from about 5 to about 45 g/l, and B) bleaching said treated element.

10. The method of claim 9 wherein said conditioning solution concentrate has a pH of from about 4.5 to about 6.5.

11. The method of claim 9 wherein said color silver halide photographic element contains an arylpyrazolone magenta dye forming color coupler.

12. The method of claim 9 for the processing of a color reversal film comprising treatment with a first development bath, a reversal bath and a color developer prior to step A, and treatment with a fixing bath and final wash after said bleaching step B.

13. The method of claim 9 wherein step A is carried out at from about 20° to about 40° C. for less than 5 minutes.

14. The method of claim 9 wherein said bleach accelerating agent is a sulfur-containing organic compound present in said concentrate in an amount of from about 5 to about 6.5 g/l.

15. The method of claim 14 wherein said bleach accelerating agent is an aliphatic thiol.

16. The method of claim 9 wherein said formaldehyde precursor is present in said concentrate in an amount of from about 225 to about 250 g/l.

17. The method of claim 9 wherein said sulfite is sodium sulfite, potassium sulfite, ammonium sulfite, lithium sulfite or a corresponding bisulfite.

* * * * *